United States Patent [19]

Alperson

[11] Patent Number: 4,993,562

[45] Date of Patent: Feb. 19, 1991

[54] WALL-MOUNTABLE GRID-SUPPORT FOR GARMENT BRACKETS

[76] Inventor: Joel H. Alperson, 3306 S. 157th St., Omaha, Nebr. 68130

[21] Appl. No.: 450,451

[22] Filed: Dec. 14, 1989

[51] Int. Cl.[5] ..... A47F 5/08

[52] U.S. Cl. ..... 211/87; 211/94; 248/225.2; 248/558

[58] Field of Search ..... 211/87, 94, 106; 248/225.2, 224.4, 220.2, 222.2, 227, 220.3, 249, 558, 215, 225.1, 340, 690, 691

[56] References Cited

U.S. PATENT DOCUMENTS

| | | | |
|---|---|---|---|
| 4,234,094 | 11/1980 | Jorgensen | 248/220.2 X |
| 4,340,144 | 7/1982 | Cousins | 211/87 |
| 4,591,058 | 5/1986 | Amstutz et al. | 211/87 X |
| 4,678,151 | 7/1987 | Radek | 211/94 X |
| 4,718,562 | 1/1988 | Winkler, Jr. | 211/87 X |
| 4,832,298 | 5/1989 | Metcalf | 248/225.2 X |
| 4,852,838 | 8/1989 | Field | 211/87 X |
| 4,860,984 | 8/1989 | Alperson | 211/87 X |
| 4,884,702 | 12/1989 | Rekow | 211/87 X |

*Primary Examiner*—Ramon O. Ramirez
*Attorney, Agent, or Firm*—George R. Nimmer

[57] ABSTRACT

A wall-mountable grid-support alternatively accommodates hook-type and slat-type garment brackets. The grid-support includes: a plurality of parallel and directionally transversely extending spacer members located at alternating small and large separations, the spacer members at colinar terminal-lengths defining a wall-abuttable first-plane and at a medial-length defining a second-plane; a plurality of parallel and directionally longitudinal linear members attached along the second-plane to widely separated locations of the spacer members medial-lengths and which, by virtue of a preferably elliptical cross-sectional shape for each bridger member, provides a third-plane; and along the first-plane, wall attachment grommets that are desireable stationed between terminal-lengths of proximal spacer members.

4 Claims, 2 Drawing Sheets

10
20M
20N
20(M,N)
21
22
23
24
25
30
30C
30D
40E
40F
40(E,F)
50
51
LS
SS
DS
P1
P2
P3
AA
aa

WALL-MOUNTABLE GRID-SUPPORT FOR GARMENT BRACKETS

BACKGROUND OF THE INVENTION

For the retail display of hangable garments, the prior art teaches various garment brackets having a horizontal bar portion for suspending garments and a shank portion adapted to be firmly supported by an appropriate wall-mountable or freestanding fixture. Among customarily employed garment brackets, those having hook-type and slat-type shank portions are prevalent; however, heretofore each type bracket requires a specially designed wall-mountable fixture. Thus, retailers who desire to utilize both hook-type and slat-type garment brackets have had to inventory two differently designed sets of wall-mountable fixtures.

GENERAL OBJECTIVE OF THE INVENTION

It is accordingly the general objective of the present invention to provide a single wall-mountable fixture that is adaptable for readily, reliably, and securely removable supporting both a hook-type and a slat-type garment bracket.

GENERAL STATEMENT OF THE INVENTION

With the above general objective in view, and together with ancillary and specific objectives which will become more apparent as this description proceeds, the wall-mountable grid-support for garment brackets of the present invention generally comprises: a plurality of parallel and directionally transversely extending spacer members located at alternating small and large separations, the spacer members at colinear terminal-lengths defining a wall-abuttable first-plane and at a medial-length defining a second-plane whereat the shank portion of a garment bracket will be supported; a plurality of parallel and directionally longitudinal linear bridger members attached along the second-plane to widely separated locations of the spacer members medial-lengths and which, by virtue of a preferably elliptical cross-sectional shape for each bridger member, provides a third-plane; along the first-plane, attachment means for attaching the grid-support to a wall or other upright environment; and desireably also directionally longitudinal linear stiffener member attached to the spacer members terminal-lengths for reinforcing the wall-mountable grid-support.

BRIEF DESCRIPTION OF THE DRAWING

In the drawing, wherein like characters refer to like parts in the several views, and in which.

DETAILED DESCRIPTION OF THE DRAWING

Figures 2, 3, 4, 5, 6:
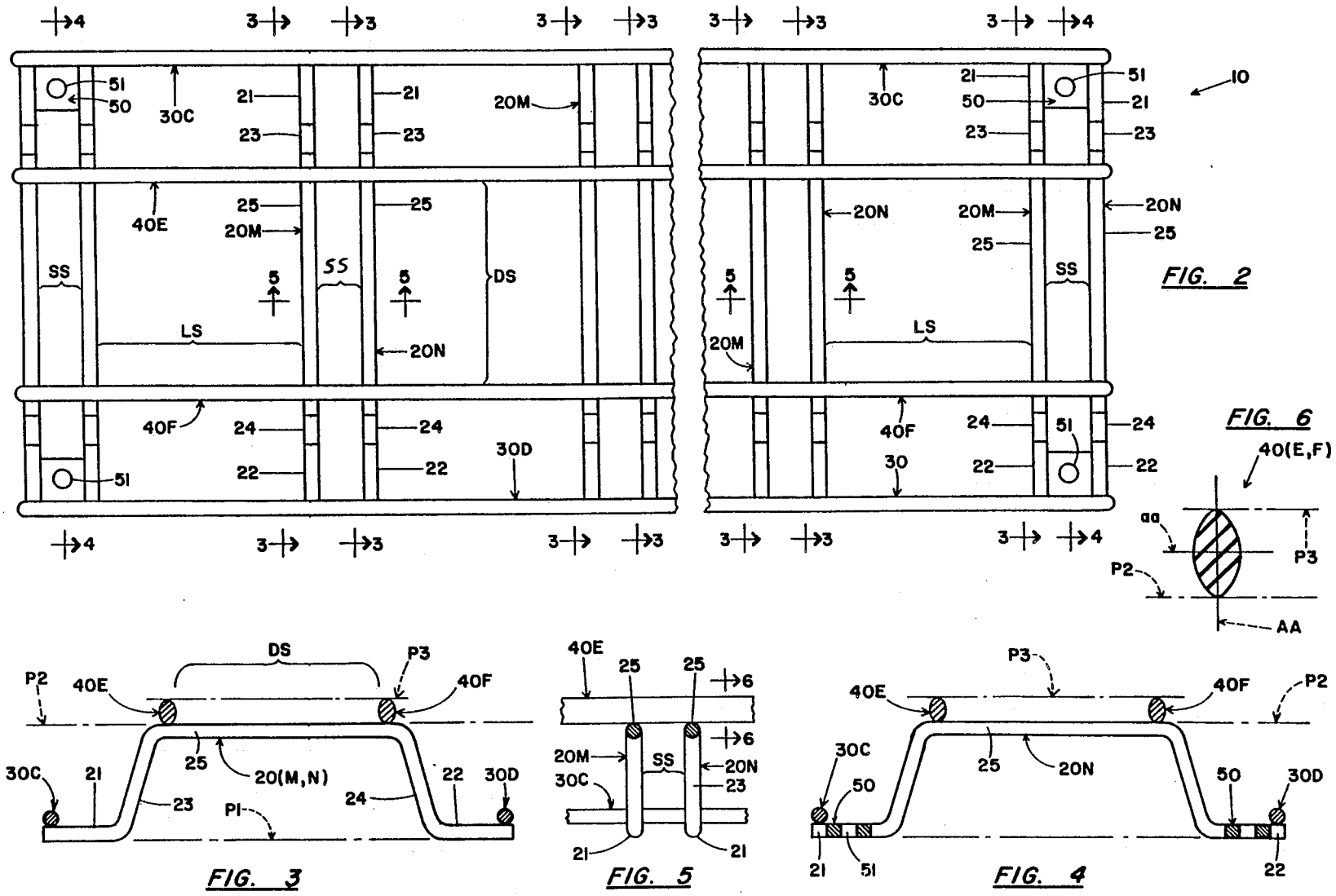
FIG. 2 is a frontal elevational view of a representative embodiment of the wall-mountable grid-support for garment brackets of the present invention.
FIGS. 3, 4, and 5, are sectional elevational views taken along the directionally transversely extending lines 3—3 and 4—4 and the directionally longitudinally extending lines 5—5 of FIG. 2.
FIG. 6 is a sectional elevational detail view taken along line 6—6 of FIG. 5.
Figure 1B:
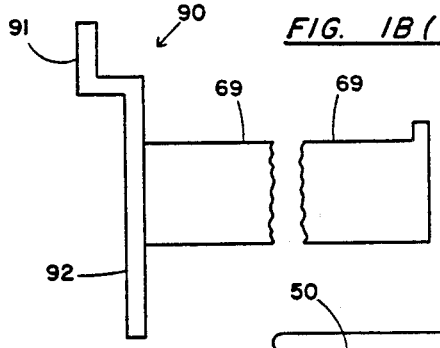
FIG. 1B (PRIOR ART)
FIG. 1B is a side elevational view of a typical slat-type garment bracket of the prior art.
Figure 7A:
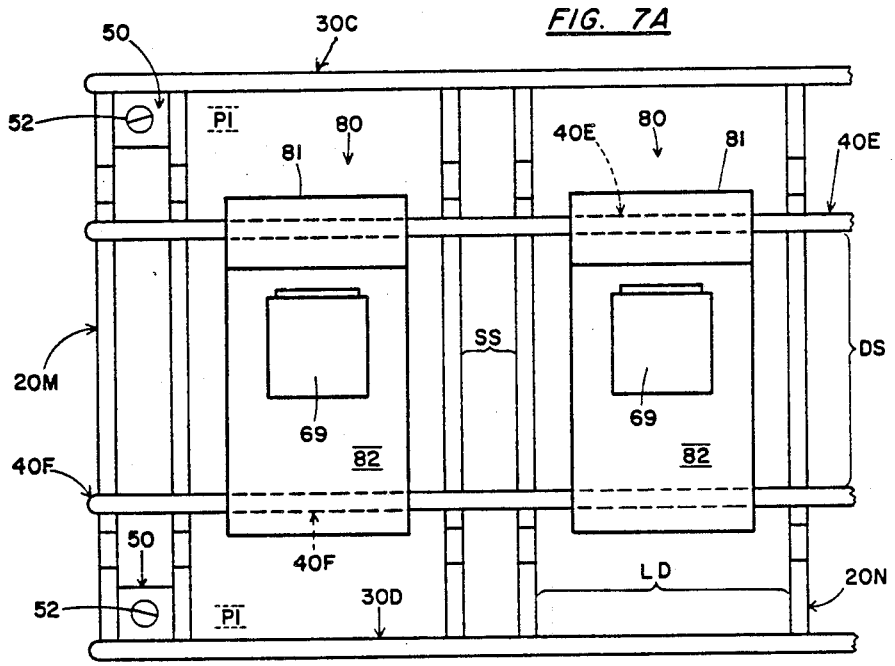
FIG. 7A is a detail frontal elevational view of the FIG. 2 grid-support mounted in a horizontal condition and thereat supporting a FIG. 1A hook-type garment bracket.
Figure 7B:
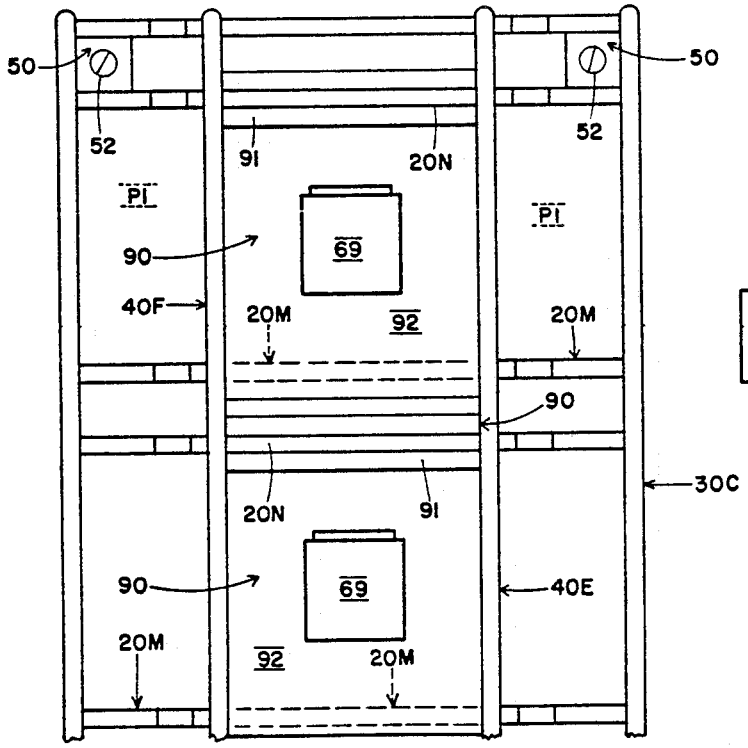
FIG. 7B is a detail frontal elevational view of the FIG. 2 grid-support mounted in a vertical condition and thereat supporting a FIG. 1B slat-type garment bracket.
Figure 1A:
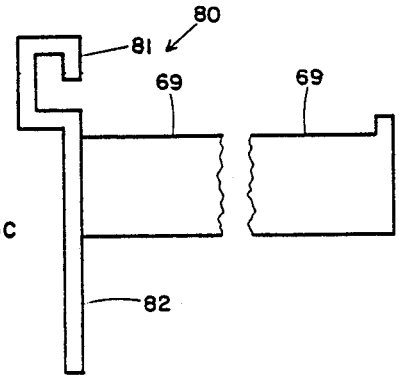
FIG. 1A (PRIOR ART)
FIG. 1A is a side elevational view of a typical hook-type garment bracket of the prior art.

As will be pointed out in connection with FIGS. 7A and 7B, the wall-mountable grid-support article (e.g. 10) is adapted to alternatively support hook-type (e.g. 80) and slat-type (e.g. 90) garment brackets. The hook-type garment bracket 80 depicted in FIG. 1A comprises a monolithic shank having a hooked upper portion 81 and a uniplanarly upright lower portion 82 and further comprises a horizontal hanger-arm 69 rigidly attached to lower portion 82. The slat-type garment bracket 90 depicted in FIG. 1B comprises a monolithic shank having a uniplanarly upright upper portion 91 that is rearwardly and directionally laterally offset from a uniplanarly upright lower portion 92 and further comprises a horizontal hanger-arm rigidly attached to lower portion 92.

As seen in FIGS. 2–5, representative embodiment 10 of the wall-mountable grid-support article generally comprises: a plurality of parallel and directionally transversely extending spacer members (20M, 20N) located at alternating small (SS) and large (LS) spacings, the spacer members at portions 21–22 defining a first-plane P1 and at a central portion 25 defining a second-plane P2; a plurality of parallel and directionally longitudinal linear bridger members (40E, 40F) attached (as by welding) along second-plane P2 to the spacer members (20M, 20N) and which, by virtue of the bridger member thickness (e.g. AA) also provides a third-plane P3; and along said first-plane P1, wall attachment means (e.g. grommets 50).

Each bridger member (20M, 20N) is preferably of regular cross-sectional shape (e.g. circular) and comprises colinear terminal-lengths including a first-length 21 and a second-length 22 whereby the terminal-lengths (21, 22) for the spacer members plurality lie along a first-plane P1. Accordingly, the terminal-lengths are adapted to collectively flatly abut a uniplanar upright wall environment. Each bridger member also comprises a linearly extending medial-length 25 that is substantially parallel to, coplanar with, and directionally laterally offset from terminal-lengths 21–22 whereby medial-length 25 defines a second-plane P2. Oblique-lengths 23 and 24 connect terminal-lengths 21 and 22, respectively, to medial-length 25. Said segments 21–25 of each spacer member may be provided of a single length of permanently bent metallic rod stock. The spacer members are arranged in a plurality of proximal pairs having a small-spacing SS therebetween; a finite large-spacing LS (that exceeds small-spacing SS by a factor of at least four) exists between consecutive proximal pairs. As will be explained in connection with FIG. 7B, large-spacing LS is roughly comparable to the upright height (91–92) of a slat-type bracket (90).

Each linear bridger member (40E, 40F), which can be of metallic rod stock, is of regular cross-sectional shape and size therealong. The cross-sectional size determines a finite small-gap separation between second-plane P2 and third-plane P3. As alluded to in FIGS. 3 and 4, and especially in FIG. 6, the bridger member cross-sectional shape is preferably elliptical having major-axis AA and minor-axis aa. Accordingly, the small-gap separation between planes P2 and P3 is preferably substantially equal to ellipse major-axis AA. The distance DS between consecutive bridger members 40E and 40F is at least fourfold that of small-spacing SS. As will be explained in connection with FIG. 7A, distance DS is roughly comparable to the upright height (81–82) of a hook-type garment bracket (80). And, as will be explained in connection with FIG. 7B, distance DS is substantially equal to the shank width for a slat-type garment bracket (90).

Structural reinforcement for grid-support 10 is provided by a pair of directionally longitudinal linear stiffener members, such as metallic rod stock, including: between planes P1 and P2, and first-stiffener 30C attached to spacer member first-lengths 21; and, between planes P1 and P2, a second-stiffener 30D attached to spacer member second-lengths 22.

Along said wall-abuttable first-plane P1, there are wall attachment means. Preferably, such wall attachment means takes the form of centrally apertured (51) rectangular grommets 50 stationed between the first-lengths 21 and the second-lengths 22 of proximally-spaced (SS) spacer members. Thus, as alluded to in FIGS. 7A and 7B, screws 52 passing through apertured grommets 50 can effect attachment to a wall or other penetrable wall environment.

As seen in FIG. 7A: For utilization with hook-type garment brackets (80), the grid-support 10 is mounted (542) in the condition wherein the bridger members (40E, 40F) extend horizontally. Accordingly, the bracket shank hooked portion 81 removably engages one bridger member (e.g. 40E) and the bracket shank lower portion 82 abuts the other bridger member (e.g. 40F).

As seen in FIG. 7B: For utilization with slat-type garment brackets (90), the grid-support is mounted (52) in the condition wherein the bridger member (40E, 40F) extend vertically. Accordingly, the entire width of the bracket shank (91–92) is securely, but removably, wedged between parallel bridger members and whereby the bracket bar 69 is maintained in horizontal condition. Especially secure and true is this removably wedged condition when the bridger members have the elliptical cross-sectional shape described hereabove.

From the foregoing, the construction and operation of the wall-mountable grid-support for garment brackets will be readily understood and further explanation is believed to be unnecessary. However, since numerous modifications and changes will readily occur to those skilled in the art, it is not desired to limit the invention to the exact construction shown and described, except as limited by the scope of the appended claims.

I claim:

1. Wall-mountable grid-support for alternatively supporting hook-type and slat-type garment brackets, and comprising:

(A) a plurality of parallel, directionally transversely extending, and respectively uniplanar spacer members, each having a regular cross-sectional shape and size therealong, and each comprising:

(Ai) a pair of colinear terminal-lengths including a first-length and a second-length whereby said terminal-lengths for said spacer members plurality lie along a first-plane and there adapted to abut a planar upright wall environment, (Aii) a linearly extending medial-length that is substantially parallel to said colinear terminal-lengths whereby the medial-lengths for said spacer members plurality lie along a second-plane that is parallel to and directionally laterally offset from said first plane, and (Aiii) said spacer members being arranged in a plurality of proximal pairs wherein a finite small-spacing exists therebetween and a finite large-spacing exists between consecutive proximal pairs;

(B) a plurality of parallel, directionally longitudinally extending linear bridger members, each said bridger member being attached to a plurality of spacer member medial-lengths to thereby establish a third-plane that is parallel to and directionally laterally offset a finite small-gap from said second-plane, and the distance between consecutive bridger members being manyfold greater than the said finite small-spacing; and (C) along said first-plane and at a said proximal pair of spacer members, wall attachment means for attaching said grid-support article to an upright wall environment.

2. The wall-mountable grid-support article of claim 1 wherein there is attached:

(a) to a plurality of said spacer member first-lengths and at a position directionally laterally away from said first-plane, a directionally longitudinally extending linear first-stiffener, and (b) to a plurality of said spacer member second-lengths and at a position directionally laterally away from said first-plane, a directionally longitudinally extending linear second-stiffener;

and wherein said wall attachment means comprises an apertured grommet stationed between the terminal-lengths of a proximal pair of spacer members.

3. The wall-mountable grid-support article of claim 1 wherein each bridger member is of regular elliptical shape therealong and with the major-axis thereof providing the finite small-gap between second-plane and third-plane.

4. Wall-mountable grid-support for alternatively supporting hook-type and slat-type garment brackets, and comprising:

(A) a plurality of parallel, directionally transversely extending, and respectively uniplanar spacer members, each having a regular cross-sectional shape and size therealong and each comprising:

(Ai) a pair of colinear terminal-lengths including a first-length and a second-length whereby said terminal-lengths for said spacer members plurality lie along a first-plane and there adapted to abut a planar upright wall environment, (Aii) a linearly extending medial-length that is substantially parallel to said colinear terminal-lengths whereby the medial-lengths for said spacer members plurality lie along a second-plane that is parallel to and directionally laterally offset from said first-plane, and (Aiii) said spacer members being arranged in a plurality of proximal pairs wherein a finite small-spacing exists therebetween and a finite large-spacing exists between consecutive proximal pairs;

(B) a directionally longitudinally extending first-stiffener member attached to a plurality of said spacer member first-lengths, and a directionally longitudinally extending second-spacer member attached to a plurality of said spacer member second-lengths;

(C) a plurality of parallel, directionally longitudinally extending linear bridger members, each said bridger member being of regular elliptical cross-sectional shape therealong and being attached to a plurality of spacer member medial-lengths to thereby establish a third-plane that is parallel to and directionally laterally offset a finite small-gap from said second-plane, said small-gap being equal to the major-axis of said elliptical shape, and the distance between consecutive bridger members being manyfold greater than the said finite small-spacing; and (D) along said first-plane and at a said proximal pair of spacer members, apertured grommet wall attachment means for attaching said grid-support article to an upright wall environment.

* * * * *